United States Patent [19]

Desmond et al.

[11] Patent Number: 4,684,122

[45] Date of Patent: Aug. 4, 1987

[54] WEIGHT EXERCISE CUFF AND ATTACHMENTS

[76] Inventors: James L. Desmond, E. Genesee St., Rd. #4; Joseph L. Locastro, 183½ Lake Ave., both of Auburn, N.Y. 13021

[21] Appl. No.: 866,811

[22] Filed: May 27, 1986

[51] Int. Cl.[4] ..... A63B 21/12

[52] U.S. Cl. ..... 272/119; 272/122; 272/143

[58] Field of Search ..... 272/67, 68, 93, 119, 272/122, 123, 124, 143; 128/87 R; 623/65

[56] References Cited

U.S. PATENT DOCUMENTS

| | | | |
|---|---|---|---|
| 2,617,650 | 11/1952 | Landis | 272/122 |
| 3,682,163 | 8/1972 | Plummer | 128/87 R |
| 3,965,491 | 6/1976 | Frenzel | 623/65 |
| 4,039,183 | 8/1977 | Sakurada | 272/143 X |
| 4,109,908 | 8/1978 | Pugh et al. | 272/119 |
| 4,330,120 | 5/1982 | Netti | 272/119 |
| 4,484,740 | 11/1984 | Green | 272/122 X |
| 4,585,228 | 4/1986 | Olson | 272/119 |

FOREIGN PATENT DOCUMENTS

| | | | |
|---|---|---|---|
| 1359159 | 3/1964 | France | 128/87 R |

*Primary Examiner*—Richard J. Apley
*Assistant Examiner*—Robert W. Bahr
*Attorney, Agent, or Firm*—Charles S. McGuire

[57] ABSTRACT

A cuff-type device which is placed about the lower forearm and wrist of a wearer and includes a number of attachments allowing the wearer to perform a wide variety of weight-related exercises while placing little or no muscular strain on the hands, fingers and wrists. A first attachment extends from the cuff over the inside of the wearer's hand and is curved to permit lifting or pulling exercises without significant stress on the fingers or hands. A second attachment provides means for attachment of cable-type exercise devices to the cuff. Threaded openings in each side of the cuff permit threaded attachment of weight-carrying bars.

11 Claims, 6 Drawing Figures

WEIGHT EXERCISE CUFF AND ATTACHMENTS

BACKGROUND OF THE INVENTION

The present invention relates to apparatus for assisting in movement (lifting, pulling, pushing, etc.) of a weight or other object by arm movement while removing or limiting stress or flexure of the fingers, hands and wrists. More specifically, the invention relates to a rigid cuff which encircles and closely engages the forearm and, if desired, the wrist of a wearer and includes cooperating structure for direct attachment of weights and/or engagement with other objects to permit lifting or other manipulation thereof, with essentially no use of the hands or fingers.

Weight training exercise for the arms and upper body normally involves the lifting of free weights in one or both hands or the manipulation of a hand-engaged member which is directly or indirectly weighted, e.g., cable-attached, guided weights or springs. Exercises employing body weight, e.g. chin-ups, also involve use of the hands.

Some forms of exercise, although intended to improve strength, muscular development, flexibility, mobility, and the like, of body areas other than the hands, nevertheless place a great deal of stress and flexure of the hands, fingers and wrists. It is thus difficult or impossible for individuals with physical restrictions on the use of these members to perform such exercises. Also, certain individuals, particularly those who depend upon hand and wrist mobility in the performance of their work, e.g., surgeons, dentists, musicians, etc., do not wish to subject their hands and wrists to the stresses which are often encountered in weight training. While certain forms of apparatus, such as those disclosed in U.S. Pat. Nos. 4,109,908 and 4,484,740, have been proposed for weight training exercises to concentrate the beneficial effects of the exercise on certain muscles or muscle groups rather than being expended in stresses on the hands or fingers, they do not provide for a full range of upper body exercises which may be performed with minimal hand, finger and wrist tension and stress.

It is a principal object of the present invention to provide apparatus which may be temporarily attached to one or both forearms and utilized in the performance of a wide variety of arm and upper body exercises without placing undue stress on the fingers, hands or wrists.

Another object is to provide a basic, forearm-encircling cuff having a variety of attachments for selective mounting thereon to allow weight manipulation with little or no movement or muscular stress of the hands and fingers.

Other objects will in part be obvious and will in part appear herinafter.

SUMMARY OF THE INVENTION

In accordance with the foregoing objects, the invention contemplates a cuff-like device hinged along one side for opening and closing movement to encircle the lower forearm of a wearer and extend from the wrist over a portion (e.g., about half) of the distance to the elbow. The cuff has a rigid exterior of metal or hard plastic, and a resilient inner lining to engage closely the wearer's arm. Suitable temporary closure means, such as Velcro straps or releasable mechanical fasteners, are provided for maintaining the cuff in the closed position.

Threaded openings extend into each side of the rigid exterior of the cuff for receiving externally threaded bars upon which weights may be mounted. A rigid, curved, lifting member may be adjustably attached to a threaded stud near the wrist-engaging end of the cuff on the inside of the forearm for vertically lifting dumbbells or bar bells. A hook, apertured clip, or similar engagement member is attached to the cuff adjacent the outside of the forearm for attachment of a cable or other weighted element.

The above and other constructional and operational features of the invention will be more readily apparent from the following detailed description and accompanying drawings, wherein:

DETAILED DESCRIPTION

Figure 1:
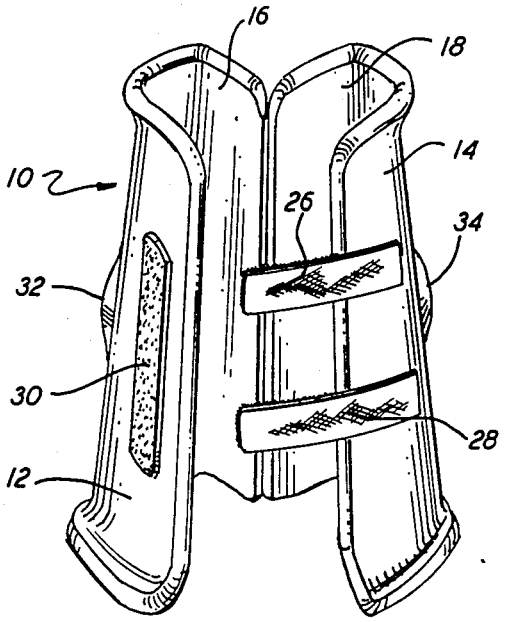
FIG. 1 is a perspective view of the cuff element of the invention, shown in the open position.
Figure 2:
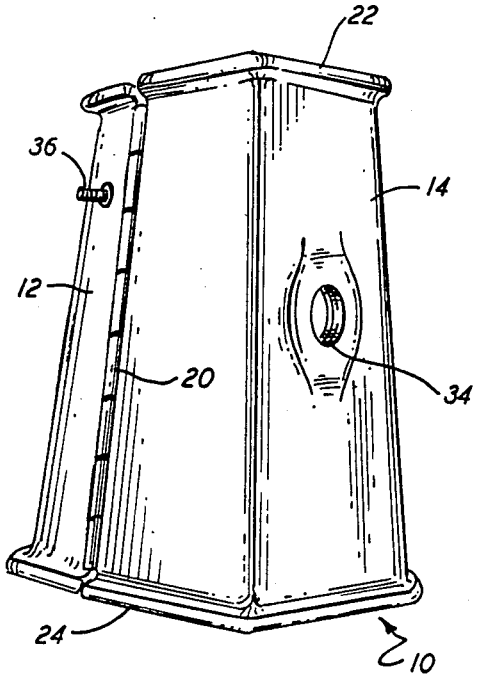
FIG. 2 is a perspective view of the cuff element from the opposite side.

Referring now to the drawings, the cuff element of the invention, denoted generally by reference numeral 10, comprises a rigid, outer shell formed in two, complementary halves 12 and 14, each having an inner surface and edges covered by resilient lining material 16 and 18, respectively. While the resilient nature of the inner lining, e.g., a layer of foam or sponge rubber which may be covered by a soft fabric or flexible plastic, will accommodate some range of size in the forearm of the wearer, cuffs 10 may be fabricated in various sizes. Cuff halves 12 and 14 are joined by hinge 20 for movement between the open position of FIG. 1, wherein the cuff may be placed over the forearm of the wearer, and the closed position of FIG. 2, wherein the cuff closely engages the lower forearm. In the closed position, cuff 10 is essentially in the form of a tapered cylinder, with both ends open, having smaller and larger ends 22 and 24, respectively. Releasable closure means, such as Velcro hook strips 26 and 28 for engagement with pile strip 30, are provided on opposite sides of the openable sides of cuff 10.

Figure 3:
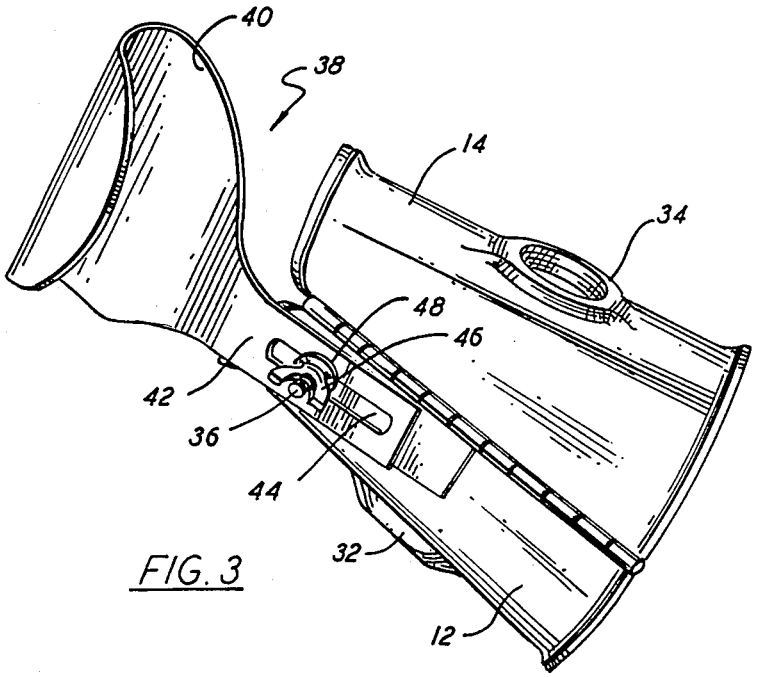
FIG. 3 is a perspective view of the cuff element showing the lifting member attached thereto.

Cuff halves 12 and 14 are provided with raised bosses 32 and 34, respectively, which surround internally threaded openings. Short, threaded stud 36 extends outwardly from cuff half 12 adjacent hinge 20, providing an attachment means for lifting member 38, as seen in FIG. 3. Member 38 is a unitary element comprising curved portion 40 and shank portion 42 having elongated slot 44 therein. Member 38 is attached to cuff 10 by placing shank portion 42 against cuff half 12 with stud 36 extending through slot 44 and tightening wing nut 46 to engage washer 48 firmly against shank portion 42. The longitudinal extent of curved portion 40 from cuff 10 may be selectively adjusted by loosening wing nut 46 and sliding shank portion 42 to the desired position with slot 44 moving along fixed stud 36. A further attachment to cuff 10, which may be either removably secured as by another threaded stud and wing nut or permanently mounted by rivets 50 is clip member 52 shown in FIG. 4.

Figure 4:
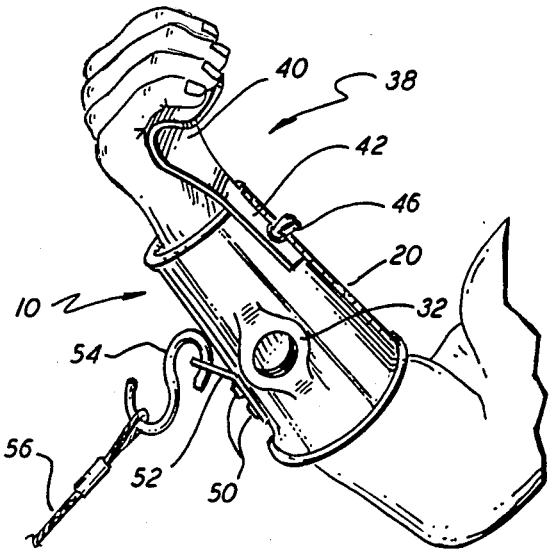
FIGS. 4, 5 and 6 are perspective views showing the cuff element and various attachments mounted on the arm of a user of the exercise equipment.
Figure 5:
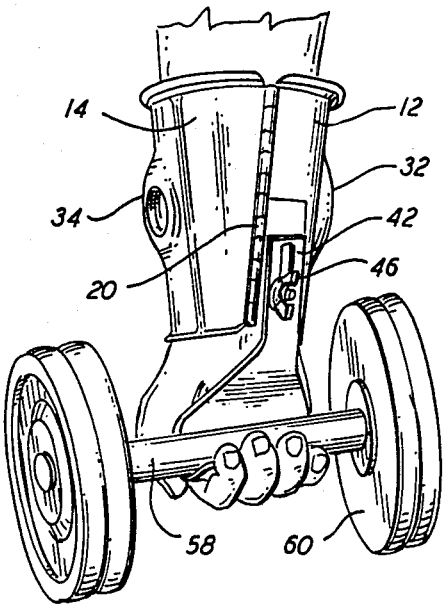
Figure 6:
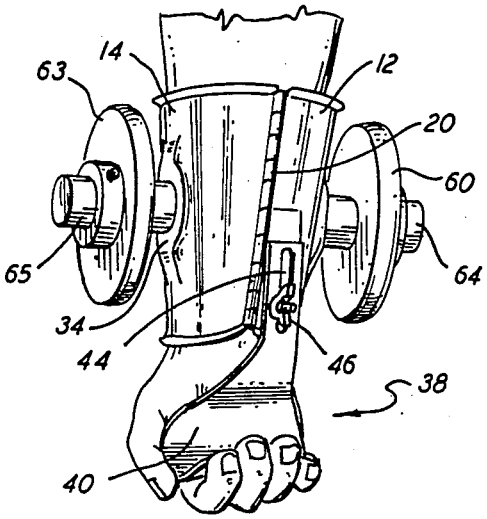

A sampling of the various arm and upper body exercises which may be performed by a wearer of cuff 10, utilizing the attachment therefor, are illustrated in FIGS. 4, 5 and 6. In the illustrated embodiment, cuff 10 is intended to be worn with hinge 20 extending along the inside of the wearer's forearm. S-shaped hook 54 is engaged at one end in an aperture in clip 52 and at the other end in a loop at the end of flexible cable 56, in the exercise shown in FIG. 4. Cable 56 extends around a pulley (not shown) and is attached to weights in well-known manner. Numerous exercises with cable-attached weights may be performed by attaching the cable end to cuff 10, all without placing any strain or exertion on the wrists, hands or fingers. Member 38 is shown attached to cuff 10 in FIG. 4, but is not used in the performance of exercises which rely on cable-attached weights with the cable attached to the cuff as shown.

The use of member 38 in lifting free weights is shown in FIG. 5. Curved portion 40 of member 38 is placed under bar 58 of dumbbell 60, which may then be lifted with no stress or strain whatsoever on the fingers or hands. Both hands may be used simultaneously, of course, to lift bar bells. It should be noted that, in addition to lifting exercises, member 38 may be used for exercises involving pulling down on weight-attached cables, or bars attached to such cables, as well as for performing pull-ups or chin-ups, without placing significant stress on the hands or fingers.

FIG. 6 illustrates the use of the invention in performing lifting exercises where the weights may be lifted over the head. That is, when lifting weights by means of curved portion 40 of member 38, as in FIG. 5, the weights cannot be lifted higher than an approximately horizontal position of the lifter's arm since member 38 is essentially inflexible and no gripping force is exerted on bar 58. Weights 62 and 63 are mounted upon bars 64 and 65 which have threaded ends engaged with the threaded openings surrounded by raised bosses 32 and 34, respectively. The arms, carrying the cuffs and weights, may then be moved to any position. Again, member 38 is shown attached to cuff 10 in FIG. 6, but may be removed, if desired, as it serves no function in the performance of such exercises.

Finally, it should be noted that cuff 10 may serve as a wrist support, in the nature of an elastic wrap, due to its close engagement with the lower forearm and wrist of the wearer, when it is desired to perform exercises with the use of the hands. For example, members 38 may be removed and the wearer of the cuffs may perform bench presses or other free weight exercises while gripping the weight bar with the hands and the cuffs will provide support for the wrists. It is also noteworthy that the cuff and attachments permit a wide variety of weight-manipulating exercises of the arms and upper body to be performed without contact by the hands or fingers of any exercise equipment, except insofar as the palm and inside of the fingers may rest lightly upon member 38 when it is attached to cuff 10. This is of great importance in permitting such exercises to be performed by persons having limited use of their hands and/or fingers because of injury or acute or chronic illnesses.

What is claimed is:

1. A cuff device with attachments permitting weight-related exercises of the arms and upper body of a wearer without placing significant stress on the hands, fingers or wrists, said cuff and attachments comprising; in combination:

(a) a body portion including a pair of rigid outer shells having resilient inner linings, said shells being constructed in complementary halves;

(b) hinge means connecting said halves for relative movement between a closed position, wherein said body portion is essentially in the form of a tapered cylinder and an open position, wherein the wearer's wrist and forearm may be placed or withdrawn from between said halves;

(c) closure means for releasably securing sid halves in said closed position;

(d) an engagement member having a shank portion releasably engageable with said body portion and extending therefrom and a curved portion overlying the palm of a wearer of the cuff and curved rearwardly toward said body portion to simulate a gripping curvature of the wearer's fingers;

(e) attachment means mounted on said body portion for attachment to the free end of a weighted cable; and (f) means on each side of said body portion for releasable attachment of a weight carrying member directly to each side of said body portion.

2. The invention according to claim 1 wherein said cuff halves are divided from one another along lines extending longitudinally of said tapered cylinder, whereby each of said halves includes two longitudinal edges, and said hinge means extends along and pivotally connects one of the edges of each of said halves.

3. The invention according to claim 1 wherein said attachment means mounted on said body portion comprises a clip permanently attached to said outer shell.

4. The invention according to claim 1 wherein said means for releasable attachment directly to each side of said body portion comprises a pair of internally threaded openings, one on each of said halves of said outer shell.

5. The invention according to claim 4 wherein said threaded openings are substantially co-axial and positioned on the sides of the forearm of a wearer of the cuff to accept the externally threaded end of a weight mounting rod.

6. The invention according to claim 1 wherein said resilient inner lining comprises a layer of foam material covering essentially the entire inner surface of each of said halves of said outer shell.

7. The invention according to claim 1 wherein said engagement member is releasably engaged with said body portion by means of a fixed member on said body portion engaging said shank portion of said engagement member.

8. The invention according to claim 7 and further including means for adjusting the position of said engagement member relative to said body portion.

9. The invention according to claim 8 wherein said adjusting means comprises an elongated slot extending through said shank portion and said fixed member on said body portion extending through said slot, whereby the position of said engagement member may be adjusted by moving said engagement member along said body portion in the direction of said slot, and releasably fixing said shank portion in the desired position.

10. The invention according to claim 1 wherein said cuff halves are divided from one another along lines extending longitudinally of said tapered cylinder, whereby each of said halves includes two longitudinal edges, and said hinge means extends along and pivotally connects one of the edges of each of said halves, and said engagement member is releasably engageable with said body portion at a position thereon adjacent said hinge means.

11. The invention accoding to claim 10 wherein said closure means comprises cooperating fastener means arranged on opposing sides of the other edges of each of said halves.

* * * * *